US009840746B2

(12) United States Patent
Lundstrom

(10) Patent No.: US 9,840,746 B2
(45) Date of Patent: Dec. 12, 2017

(54) TILTING MECHANISM FOR A VESSEL

(71) Applicant: UVAN HOLDING AB, Taby (SE)

(72) Inventor: Christoffer Lundstrom, Vallentuna (SE)

(73) Assignee: UVAN HOLDING AB, Taby (SE)

( * ) Notice: Subject to any disclaimer, the term of this patent is extended or adjusted under 35 U.S.C. 154(b) by 199 days.

(21) Appl. No.: 14/403,934

(22) PCT Filed: May 15, 2013

(86) PCT No.: PCT/EP2013/060039
§ 371 (c)(1),
(2) Date: Nov. 25, 2014

(87) PCT Pub. No.: WO2013/178468
PCT Pub. Date: Dec. 5, 2013

(65) Prior Publication Data

US 2015/0102539 A1 Apr. 16, 2015

(30) Foreign Application Priority Data

May 30, 2012 (EP) ..... 12170021

(51) Int. Cl.
*C21C 5/50* (2006.01)
*C21C 5/46* (2006.01)
*C21C 5/48* (2006.01)

(52) U.S. Cl.
CPC ..... *C21C 5/50* (2013.01); *C21C 5/464* (2013.01); *C21C 5/4613* (2013.01); *C21C 5/48* (2013.01)

(58) Field of Classification Search
CPC ..... C21C 5/50; C21C 5/34
USPC ..... 266/245
See application file for complete search history.

(56) References Cited

U.S. PATENT DOCUMENTS 3,531,074 A * 9/1970 Van Dine ..... B22D 41/06 248/141
3,895,786 A * 7/1975 Eysn ..... C21C 5/50 266/240
4,093,192 A 6/1978 Riegler et al.
4,224,836 A 9/1980 Riegler et al.
4,516,757 A * 5/1985 Langlitz ..... C21C 5/34 266/245

(Continued)

FOREIGN PATENT DOCUMENTS

CN 1844820 A 10/2006
DE 2201296 A1 8/1972

(Continued)

OTHER PUBLICATIONS

Chinese Office Action dated Jan. 12, 2016, for Chinese Patent Application No. 201380035142.5.

(Continued)

*Primary Examiner* — Scott Kastler
(74) *Attorney, Agent, or Firm* — Karceski IP Law, PLLC

(57) ABSTRACT

The invention relates to a tilting mechanism for a tilting metallurgical vessel, in particular a converter, around a horizontal axis, comprising a rotatable shaft and at least one tilting drive mechanism for rotating the vessel about the axis, the at least one tilting drive mechanism has a fixed part and a moving part, wherein the moving part of the at least one tilting drive mechanism is directly connected to one end of the rotatable shaft.

14 Claims, 7 Drawing Sheets

(56) References Cited

U.S. PATENT DOCUMENTS

| | | | | |
|---|---|---|---|---|
| 4,592,539 | A | 6/1986 | Willaschek | |
| 4,660,809 | A | 4/1987 | Langlitz et al. | |
| 2015/0102539 | A1* | 4/2015 | Lundstrom | C21C 5/50 266/44 |

FOREIGN PATENT DOCUMENTS

| | | | | |
|---|---|---|---|---|
| GB | 550 | | | 0/1913 |
| JP | S5597302 | U | | 7/1980 |
| JP | 55127994 | U | | 9/1980 |
| JP | S60125313 | A | | 7/1985 |
| JP | H07318254 | A | | 12/1995 |
| JP | 2004156125 | A | * | 6/2004 |

OTHER PUBLICATIONS

International Search Report dated Feb. 18, 2014 for International Patent Application No. PCT/EP2013/060039.

Written Opinion (PCT Rule 43bis. 1) (undated) for International Patent Application No. PCT/EP2013/060039.

Written Opinion (PCT Rule 66) dated Jun. 30, 2014 for International Patent Application No. PCT/EP2013/060039.

Riedel W et al: "Design Problems in Transition to Large Capacity Basic Oxygen Furnaces", Iron and Steel Engineer, vol. 40, No. 84, Apr. 1, 1963, pp. 155-172.

Ridel, W. and Rubo, E., "Design Problems in Transition to Large Capacity Basic Oxygen Furnaces," Iron and Steel Engineer, vol. 865, No. 40, pp. 153-169 (Apr. 1963).

"Primetals Technologies to modernize LD (BOF) converter for HKM in Germany," press release from Primetals Technologies dated Nov. 3, 2015.

"High-Powered Tilt Drives for BOF and AOD Converters," a publication by the SMS Group, downloaded from the Internet on Mar. 24, 2017.

Japanese Office Action dated Feb. 6, 2017, for Japanese Patent Application No. 2015-514409.

* cited by examiner

TILTING MECHANISM FOR A VESSEL

CROSS-REFERENCE TO RELATED APPLICATION(S)

This is a National Stage Entry into the United States Patent and Trademark Office from International Patent Application No. PCT/EP2013/060039, having an international filing date of 15 May 2013, which claims priority to European Patent Application No. 12170021.5, filed 30 May 2012, the entire contents of both of which are incorporated herein by reference.

TECHNICAL FIELD

The present invention relates to a tilting mechanism for a tilting metallurgical vessel, in particular a converter, around a horizontal axis, comprising trunnions and at least one tilting drive mechanism for rotating the vessel about the axis.

BACKGROUND ART

A metallurgical vessel which can rotate around its own axis in order to enable refilling and emptying of melted metal is widely used in metallurgic industry. Examples include e.g. converters for refining processes and crucibles for casting. Traditionally, in order to tilt the converter, a motor is coupled to a spur gear which is mounted on an axis of the vessel and with a torque which transmits the reaction force to a fundament. An example is seen in U.S. Pat. No. 4,224,836 wherein a tilting drive arrangement for a converter has a spur gear fastened to a tilting trunnion of the converter and engages with at least two pinions driven by a motor. Known arrangements and methods for tilting have certain disadvantages, and there is room for improvements of tilting solutions in the field.

SUMMARY OF THE INVENTION

It is an object of the present invention to provide an improved tilting mechanism for a vessel, in particular a converter. This and other objects are achieved by means of a tilting mechanism.

Further advantageous embodiments of the invention have been specified in the dependent claims.

According to the invention the moving part of the at least one tilting drive mechanism is directly connected to one end of the trunnions about which the vessel is arranged to tilt. The claimed solution provides a number of advantages, for instance related to refining processes in a converter. During a refining process gases and sometimes liquids are infused/introduced into the converter, comprising e.g. oxygen, nitrogen, argon, natural gases, steam/water, carbon dioxide and pressurized air. Because of the impulse from the infused gas and chemical reactions, in particular between oxygen and substances in the metal bath, heavy vibrations are generated in the vessel. In a traditional converter assembly these vibrations are transmitted into the gears/gear box which are normally arranged between the motor and the tilt trunnions, leading to wear and tear of the gear cogs as well as to transmission of vibrations to the fundament. Thus, worn out gears need to be replaced frequently which is a costly and time consuming procedure. The invention provides a system wherein the tilting drive mechanism actuates tilting by directly engaging with the axis, with no intermediate gear mechanics, whereby required maintenance of the system is significantly reduced.

The claimed invention also provides advantages related to maneuvering of a metallurgical vessel, such as a crucible used for casting or a converter. Since the at least one tilting drive mechanism is directly connected to at least one end of the horizontal to trunnions gaps in transmission mechanics are eliminated. Thereby the tilting of the vessel becomes safer and more predictable as compared to known tilting arrangements.

According to one embodiment of the invention the tilting drive mechanism is a motor which directly engages with at least one end of the horizontal trunnions, i.e. without any gears.

According to another embodiment of the invention the tilting drive mechanism is a hydraulic motor, which is directly connected to at least one end of the horizontal trunnions, i.e. without any gears. The use of a hydraulic motor as a tilting drive mechanism provides a number of advantages compared to traditional drive mechanisms with transmission gears:

- Improved balance during tilting movements.
- Quick, easy speed adjustment over a wide range while the power source is operating at a constant (most efficient) speed.
- Rapid and smooth acceleration or deceleration.
- Improved control over maximum torque and power.
- Cushioning effect reducing shock loads.
- Smoother reversal of motion.
- Reduced moment of inertia.
- No gap in the motor leading to tear, in particular during refining procedures.
- Possibility to achieve gradual adjustment of rotational speed with retained maximal torque.
- Immediate maximum torque even at low speed ranges.

The invention is defined in the claims.

According to one aspect of the invention the hydraulic motor may be arranged to minimise vibrations during refining process. Furthermore the hydraulic oil may function as a vibration damper for a metallurgical vessel, in particular for a converter used in refining processes where generation of heavy vibrations are unavoidable. According to the invention such a method of reducing vibrations during blowing in a converter comprises the steps of providing a converter assembly having a tilting mechanism according to the invention, positioning the converter in the blow position without locking the converter, and allowing the converter to swing around the horizontal axis during oxygen blowing, thereby reducing the vibrations. Preferably the method for reducing vibrations further comprises the step of regulating the swing movement by adjusting the flow of hydraulic oil from the inlet side to the outlet side, by constriction of the fluid passway, preferably by the use of a piloted counterbalance valve connecting the inlet and the outlet side of the hydraulic motor.

According to one aspect of the invention the hydraulic motor comprises a pressure inlet opening and an outlet opening, wherein the inlet (pressure) and outlet openings of the hydraulic motor are connected which leads to that the converter will turn around its own axis. Hereby the forces and vibrations that are transmitted to the fundament are minimised.

In one aspect of the invention, in order to avoid too large oscillations the conduit between the inlet and outlet openings are furnished with a variable constriction which enables adjustment of the size of the allowable impulses/oscillations.

Further details characterizing the present invention will be disclosed in the hereinafter following detailed description.

BRIEF DESCRIPTION OF THE FIGURES

In the following, the invention will be described in more detail with reference to preferred embodiments and the appended drawings.

DETAILED DESCRIPTION OF THE FIGURES

In the following detailed description a metallurgical vessel is generally designated 1 and is shown in FIGS. 1-5 in the form of a converter 1, although it is to be understood that other types of vessels could be included in a system according to the invention.

Figure 1:
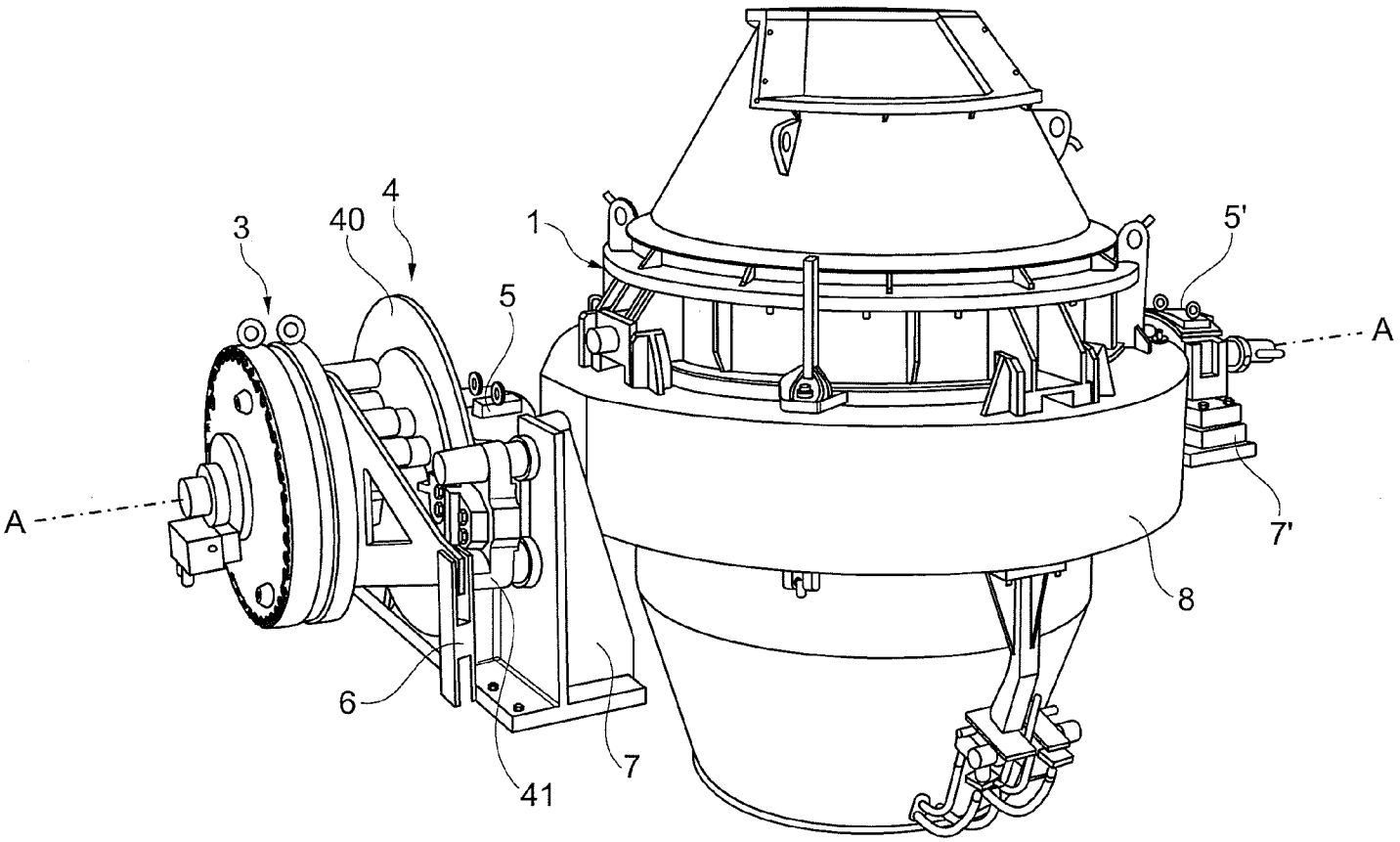
FIG. 1 is a schematic perspective view of a converter assembly according to the invention.
Figure 2:
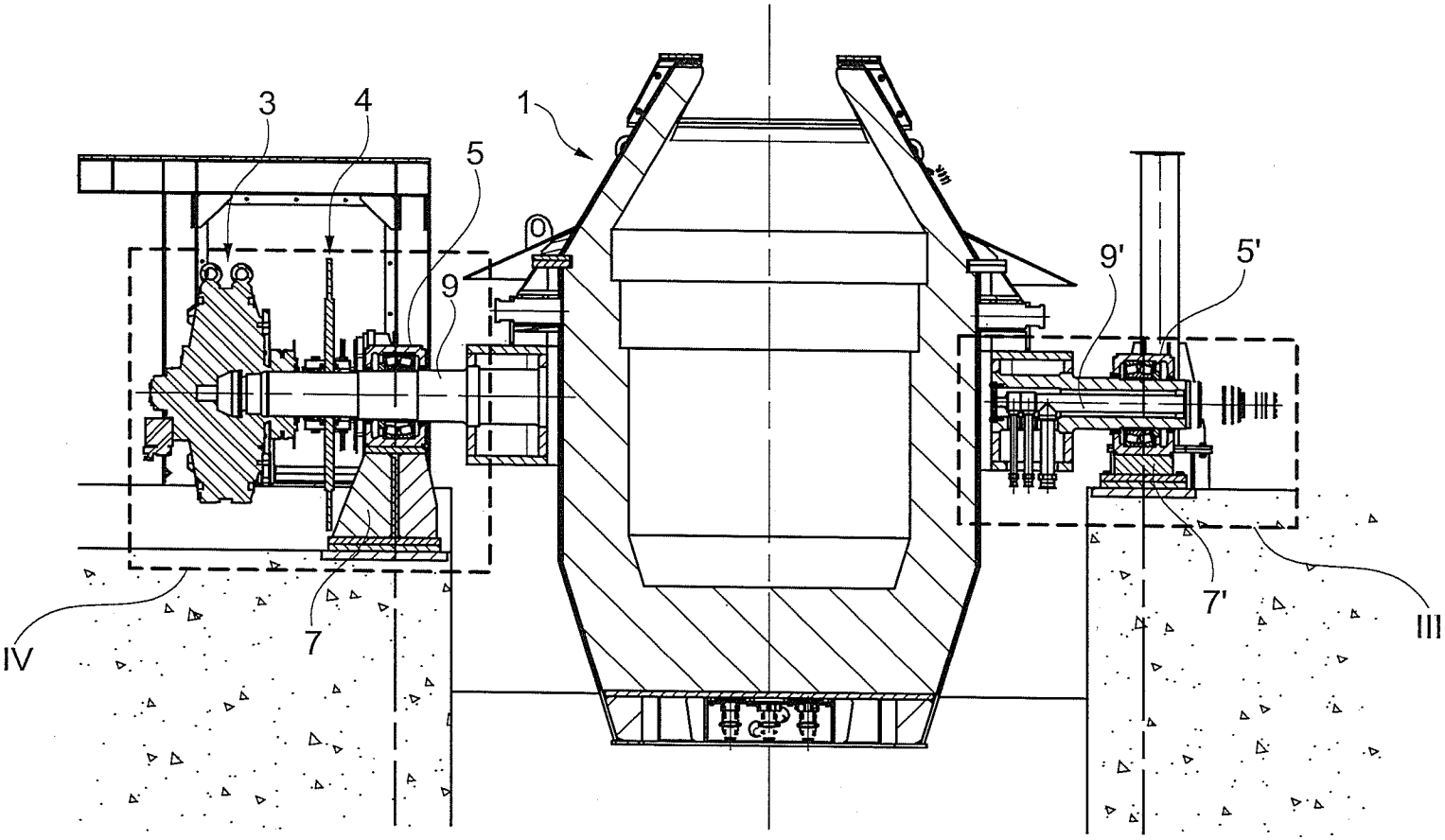
FIG. 2 is a cross sectional view of the system according to FIG. 1.

Referring first to FIGS. 1-2, a converter 1 is inserted in a trunnion ring 8, which is connected to trunnions 9, 9' journaled in bearings 5, 5' symmetrically arranged at either side of the vessel 1 and arranged on fixed supports 7, 7' located diametrically opposite each other and centered on a horizontal axis A.

As a safety measure the vessel 1 is inserted in the trunnion ring 8 in such a way that the center of mass of the vessel 1 is positioned below the horizontal plane of the trunnion ring 8, regardless of whether the vessel is empty or filled with content. This means that the converter will strive to assume a "neutral position" corresponding to the position seen e.g. in FIG. 1.

The trunnions 9, 9' extend along the horizontal central axis A and are elongated beyond the respective bearings 5, 5'. One of the trunnion shafts 9 is connected in its outer end to a tilting drive mechanism 3 arranged to rotate the vessel 1 about the axis A. The tilting drive mechanism 3 has a fixed part and a moving part, wherein the moving part is directly connected to the end of the trunnion shaft 9 with no intermediate gears as will later be described in more detail. A lever arm 6 is mounted between the fundament and the fixed part of the motor 3 and is arranged to support the motor 3 during tilting of the vessel 1.

A breaking assembly 4 is arranged at one of the trunnion shafts 9, said breaking assembly comprising a breaking disc 40 and a hydraulically operated break caliper 41.

Figure 3:
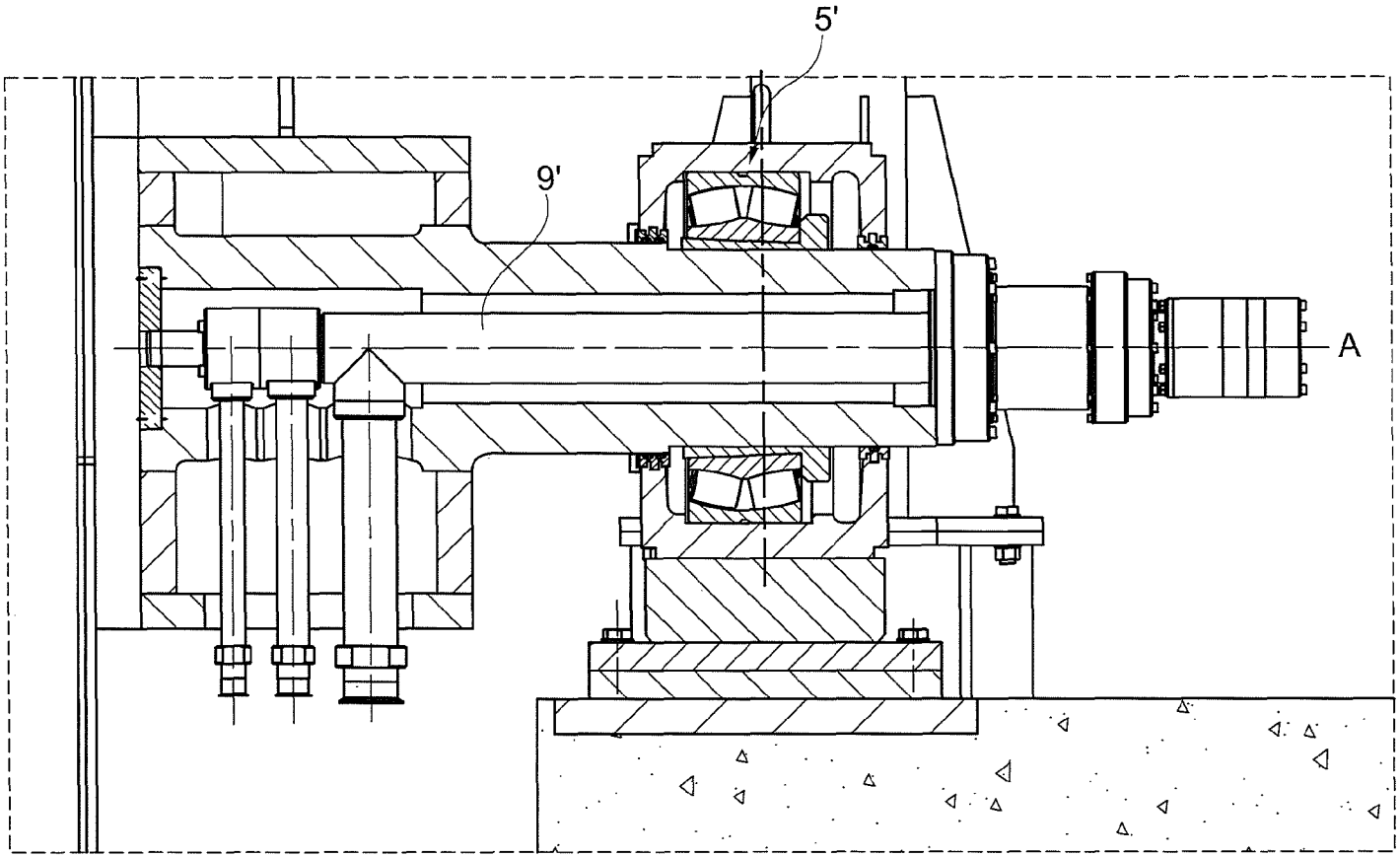
FIG. 3 is a detail view according to III in FIG. 2.

In the detail view of FIG. 3 there is seen one of the trunnions 9' and its corresponding bearing 5'.

Figure 4:
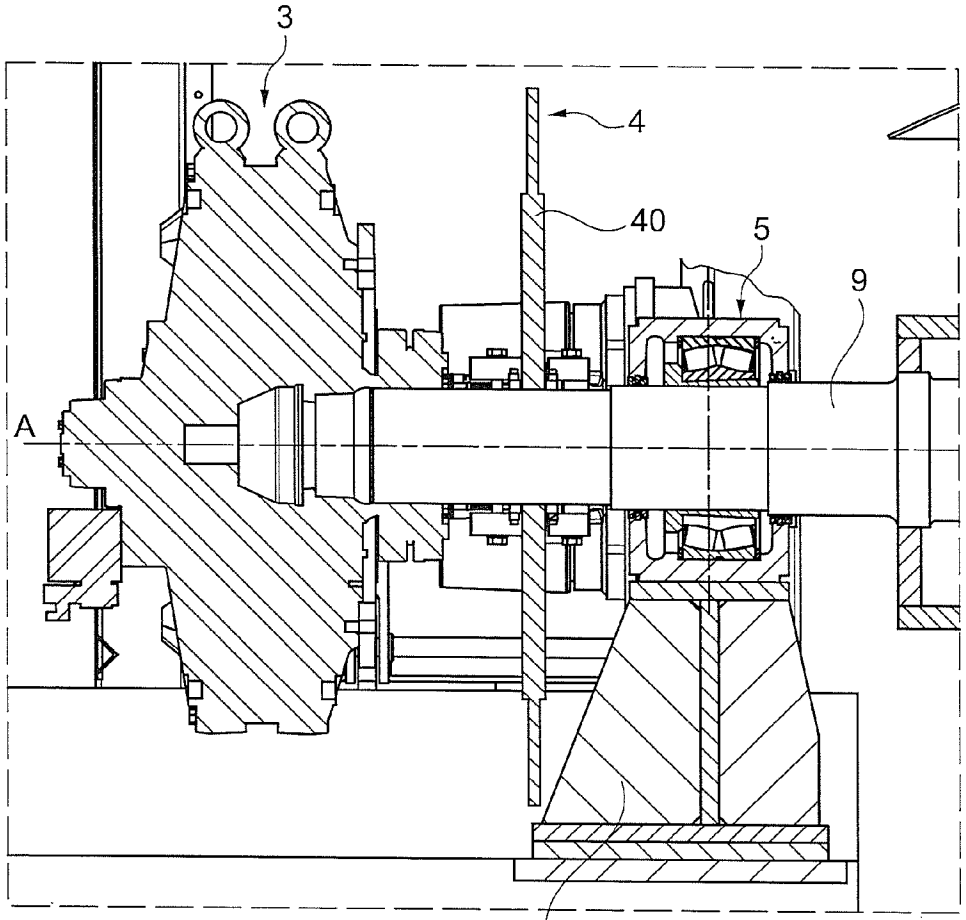
FIG. 4 is a detail view according to IV in FIG. 2, FIGS. 5*a-b* show perspective views of a tilting mechanism, and FIGS. 6*a-c* schematically illustrate a hydraulic system.
Figure 5A:
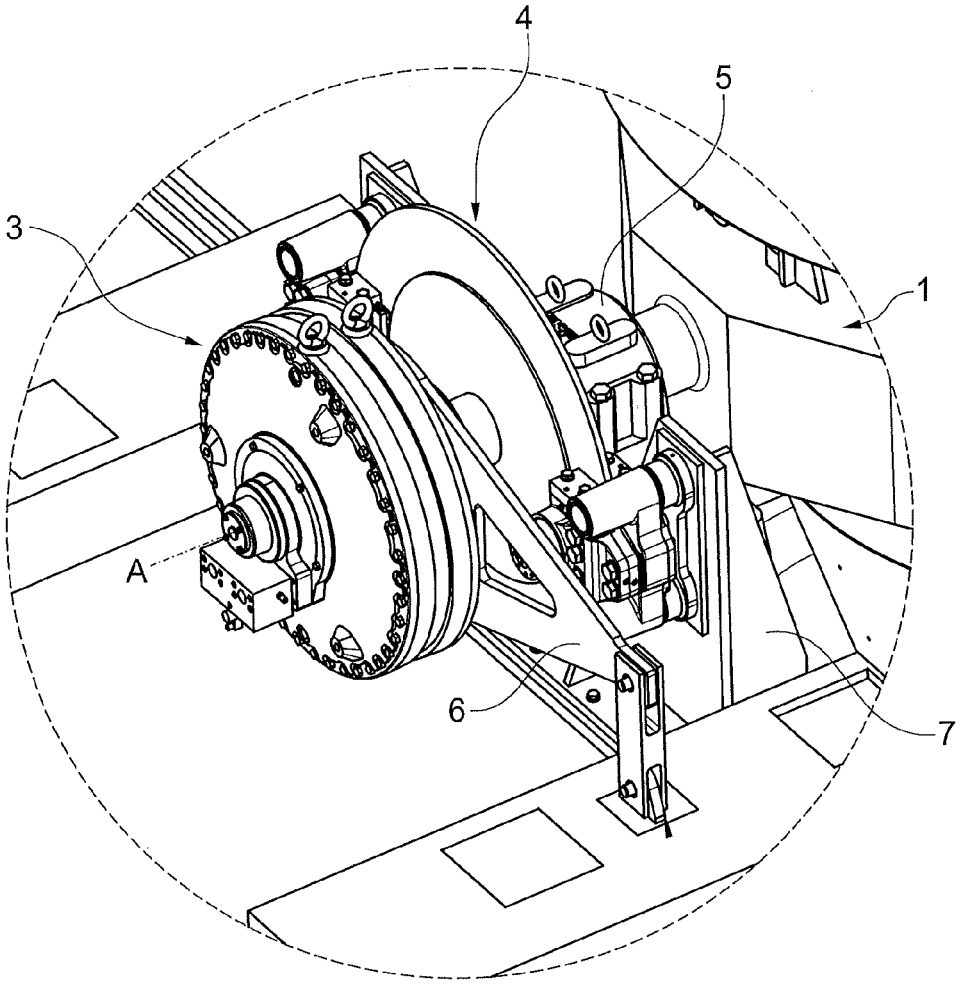
Figure 5B:
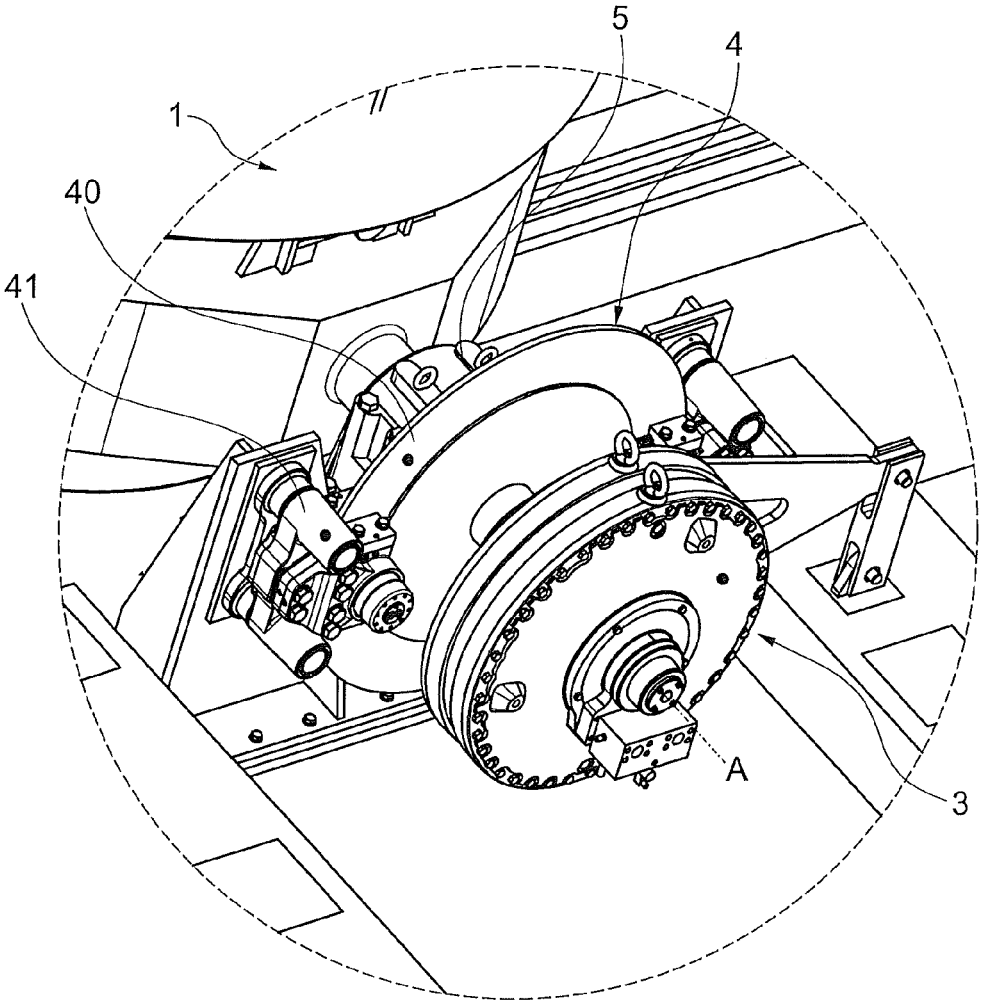

The tilting drive mechanism 3 will now be further described, referring mainly to FIGS. 4-5, where FIG. 4 shows a detail view according to IV of FIG. 2, and FIGS. 5*a-b* pictures the drive mechanism 3 from different perspective views.

The end portion of one of the trunnion 9 is directly connected to the tilting drive mechanism 3. Although the system in the figures is shown with one tilting drive mechanism 3 engaging one trunnion 9 it is understood that it is within the scope of the invention to provide a second tilting drive mechanism engaging also the opposite trunnion 9'. Two tilting drive mechanisms could provide a system with rotation drive at each side of the vessel 2, enabling the use of one of the drive mechanisms for rotation and the other as a counteracting break.

Said tilting drive mechanism 3 comprises a motor, preferably a hydraulic motor, which operably engages with the moving part of the tilting drive to tilt the converter 1 about the horizontal axis A. The hydraulic motor 3 is powered by a hydraulic pump unit (not shown), which in its turn is driven by a pump motor. Typically but not necessarily the motor chosen may have a speed range from 0-3 rpm. The torque of the motor is chosen depending on maximum tilting torque of the converter.

Figures 6A, 6B, 6C:
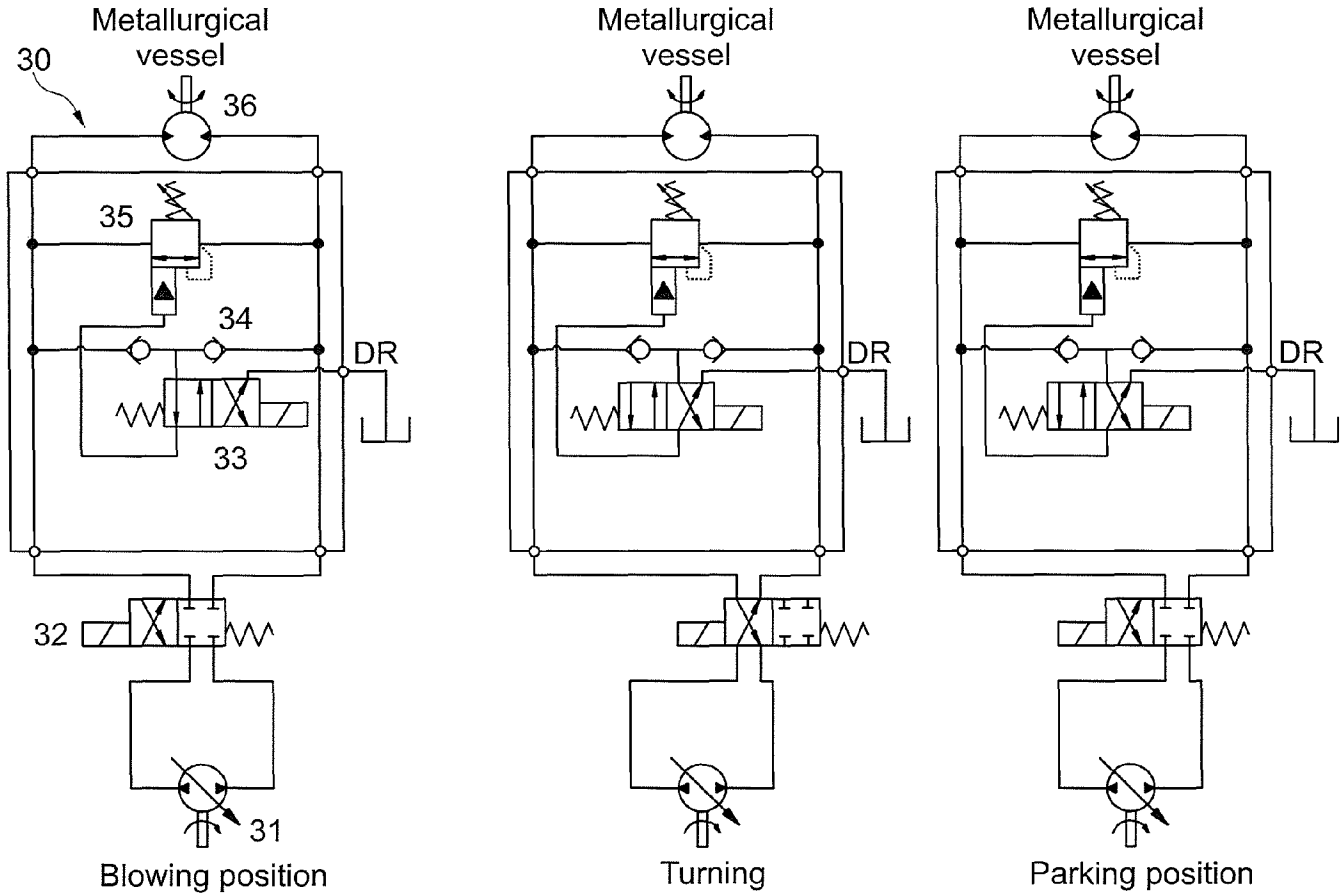

FIGS. 6*a-c* schematically illustrates a hydraulic system 30 according to one aspect of the invention. Said system 30 comprises adjustable pump 3 with flow control in both directions, a shut-off valve 32, a direction valve 33, two non-return valves 34, adjustable counter balance valve (pilot controlled) and hydraulic drive means 36.

In FIG. 6*a* there is seen the hydraulic system 30 during the refining procedure. According to one aspect of the invention the hydraulic system of the hydraulic motor 3 is used for dampening the vibrations, which are generated during refining procedures. During blowing of process gases the shut off valve 32 is closed and the drive is used as a vibration damper. The vessel 2 is allowed to move by letting the oil from the high pressure side of the drive be direct through direction valve 33 and pilot assist the counter balance valve 35 which then will allow oil flow from the high pressure side to the low pressure side, which will cause the drive to move. The speed of movement is set by adjusting the opening of the counter balance valve 35. The converter will always strive to reach its neutral position, where it is normally desired to keep it during blowing.

FIG. 6*b* illustrates the hydraulic system 30 when tilting the vessel 2. When the vessel is tilted the shut-off valve 32 is opened and the direction valve 33 does not allow passage of oil flow from the high pressure side. Thereby the counter balance valve 35 is kept blocked. The speed and direction of the drive is set by adjusting the pump.

FIG. 6*c* illustrates the hydraulic system 30 when parking the vessel 2 e.g. for sampling. When the vessel 2 is parked in a position other than its neutral position the shut-off valve 32 is closed and the direction valve 33 is arranged to prevent oil from flowing from the high pressure side leading to that the counter balance valve 35 is kept in a blocked configuration. The converter will then remain in its parking position.

The invention is not to be seen as limited by the embodiments described above, but can be varied within the scope of the claims, as will be understood by the person skilled in the art. For instance, the metallurgical vessel 2 may be a converter or a crucible, and in case of a converter any tiltable converter type including e.g. AOD, CLU and LD converters. Thus it is also understood that a converter may be provided with one or more means for oxygen gas blowing, the means being lances and/or bottom tuyeres and/or side tuyeres.

The invention claimed is:

1. A tilting mechanism for a metallurgical vessel, comprising:

a trunnion ring defining a horizontal plane, wherein the metallurgical vessel is disposed in the trunnion ring such that a center of mass of the metallurgical vessel is below the horizontal plane;

first and second trunnions connected to the trunnion ring defining a horizontal axis;

first and second fixed supports adapted to provide support between the first and second trunnions and a fundament;

a first tilting drive mechanism connected to the first trunnion to tilt the metallurgical vessel, wherein the first tilting drive mechanism comprises a moving part connected to the first trunnion, a fixed part fixedly connected between the moving part and the fundament without gears, an adjustable hydraulic pump, and a flow control unit connected between the adjustable hydraulic pump and the moving part.

2. The tilting mechanism of claim 1, wherein the first tilting drive mechanism is a hydraulic motor.

3. The tilting mechanism of claim 1, further comprising:

first and second bearings, supported on the first and second fixed supports, wherein the first and second bearing support the first and second trunnions, respectively.

4. The tilting mechanism of claim 1, further comprising:

a second tilting drive mechanism connected to the second trunnion to tilt the metallurgical vessel.

5. The tilting mechanism of claim 2, further comprising:

a hydraulic system feeding the hydraulic motor, wherein the hydraulic system comprises the adjustable hydraulic pump, the flow control unit, and a shut-off valve interposed between the adjustable hydraulic pump and the flow control unit.

6. The tilting mechanism of claim 5, wherein the flow control unit comprises:

a direction valve and a piloted counterbalance valve connected between an inlet side and an outlet side of the hydraulic motor.

7. The tilting mechanism of claim 6, wherein, when the shut-off valve is closed, a closed fluid passway is established between a high pressure side and a low pressure side of the hydraulic motor, permitting oil to flow through the direction valve and the piloted counter balance valve.

8. The tilting mechanism of claim 3, further comprising a braking assembly disposed on the first trunnion.

9. A converter assembly, comprising:

a converter comprising the metallurgical vessel; and the tilting mechanism according to claim 1.

10. The converter assembly of claim 9, wherein the converter comprises:

at least one blower for blowing oxygen gas, the blower being at least one of lances, bottom tuyeres, and side tuyeres.

11. The converter assembly according to claim 9, wherein the tilting mechanism further comprises a braking assembly disposed on the first trunnion.

12. A method of reducing vibrations during blowing in a converter, comprising:

providing a converter assembly comprising a converter and a tilting mechanism for the converter, wherein the tilting mechanism comprises a trunnion ring defining a horizontal plane, wherein the converter is disposed in the trunnion ring such that a center of mass of the metallurgical vessel is below the horizontal plane, first and second trunnions connected to the trunnion ring defining a horizontal axis, first and second fixed supports adapted to provide support between the first and second trunnions and a fundament, a first tilting drive mechanism connected to the first trunnion to tilt the metallurgical vessel, wherein the first tilting drive mechanism comprises a moving part connected to the first trunnion, a fixed part fixedly connected between the moving part and the fundament without gears, an adjustable hydraulic pump, and a flow control unit connected between the adjustable hydraulic pump and the moving part; a shut-off valve interposed between the adjustable hydraulic pump and the flow control unit;

positioning the converter in a blow position without locking the converter; and allowing the converter to swing around the fixed, horizontal axis during oxygen blowing, thereby reducing vibrations.

13. The method of claim 12, further comprising:

regulating swing movement by adjusting flow of hydraulic oil from an inlet side to an outlet side of the hydraulic motor by constricting a fluid passway.

14. The method of claim 13, wherein a piloted counterbalance valve: is disposed between the inlet side and the outlet side to assist with the regulating.

* * * * *